US006478057B1

(12) United States Patent
Bearss et al.

(10) Patent No.: US 6,478,057 B1
(45) Date of Patent: Nov. 12, 2002

(54) APPARATUS FOR INFLATING BALLOONS

(76) Inventors: Christopher L. Bearss, 12658 Richfield Ct., Livonia, MI (US) 48150; Yakov Rozenberg, 36725 Greenspring St., Farmington Hills, MI (US) 48331-1907

( * ) Notice: Subject to any disclaimer, the term of this patent is extended or adjusted under 35 U.S.C. 154(b) by 0 days.

(21) Appl. No.: 09/978,612

(22) Filed: Oct. 16, 2001

Related U.S. Application Data

(60) Provisional application No. 60/296,702, filed on Jun. 7, 2001.

(51) Int. Cl.[7] ..... B65B 1/04

(52) U.S. Cl. ..... 141/313; 141/114; 446/220

(58) Field of Search ..... 141/114, 313–319, 141/391, 10; 446/220

(56) References Cited

U.S. PATENT DOCUMENTS

| | | | | |
|---|---|---|---|---|
| 2,776,530 A | | 1/1957 | Baumgardner | |
| 3,161,998 A | | 12/1964 | Lennox | |
| 3,191,801 A | | 6/1965 | Standish | |
| 3,380,490 A | | 4/1968 | Ellenberg et al. | |
| 3,536,110 A | | 10/1970 | West | |
| 3,692,071 A | * | 9/1972 | Begleiter | 137/512.3 |
| 5,016,428 A | | 5/1991 | Helling et al. | |
| 5,370,161 A | * | 12/1994 | Shafer | 141/114 |
| 5,651,402 A | | 7/1997 | McCaul | |
| 5,653,272 A | | 8/1997 | McCaul | |

* cited by examiner

*Primary Examiner*—Steven O. Douglas
(74) *Attorney, Agent, or Firm*—Young & Basile, P.C.

(57) ABSTRACT

An apparatus for selectively inflating multiple balloons simultaneously, sequentially, or in random order include a housing for storing pneumatic and electrical control devices and gas conduits. Ports are formed through the housing and each having a nozzle secured thereon. One end of one gas conduit is connected to an external source of pressurized gas and another end is in communication with the ports. An actuator is associated with each port for selectively actuating the delivery of pressurized gas to the associated nozzle manually or automatically. Each port may be automatically closed when predetermined parameters are met in the automatic mode.

20 Claims, 6 Drawing Sheets

APPARATUS FOR INFLATING BALLOONS

CROSS-REFERENCE TO RELATED APPLICATIONS

This application claims priority of Provisional Patent Application Ser. No. 60/296,702 filed Jun. 7, 2001.

FIELD OF THE INVENTION

The invention relates to an apparatus for inflating balloons.

BACKGROUND OF THE INVENTION

Although balloons are used as scientific and transportation devices, to the general public, balloons are most popular as entertainment devices, especially at parties and amusement parks. It is common to provide a gift of multiple balloons for birthdays or other celebrations. However, often times the facilities, such as retail stores and vendors providing the service, only have the capability to inflate a single balloon at a time. As a result, long lines are formed at the facilities causing impatient customers and loss of sales. In addition, the operator of the balloon inflation device must monitor the inflation of the balloon continuously so that the balloon is not over-inflated. While the operator is monitoring the inflation of the balloon, other work at the facilities, and especially at a retail store cannot be accomplished. Therefore, the process of inflating balloons in the prior art is a slow and labor-consuming job.

SUMMARY OF THE INVENTION

It is the intent of the invention to address the aforementioned concerns. The invention provides an apparatus for inflating balloons which is releasibly connectable to a source of pressurized gas. The apparatus comprises a means for selectively inflating a single balloon or a plurality of balloons simultaneously, in sequence, or in random order wherein the means for selectively inflating the balloons include at least two nozzles communicating with the source of pressurized gas. Each nozzle has a free end for receiving a portion of the balloon thereon, wherein the free end is configured for a secure and releasibly sealing connection to the balloon during the inflation thereof.

In another aspect of the invention, the apparatus includes an actuator associated with each nozzle for selectively actuating the delivery of pressurized gas to the associated nozzle either manually or automatically.

In a further aspect of the invention, the apparatus includes means for automatically stopping the flow of pressurized gas to a balloon.

Other applications of the present invention will become apparent to those skilled in the art when the following description of the best mode contemplated for practicing the invention is read in conjunction with the accompanying drawings.

DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
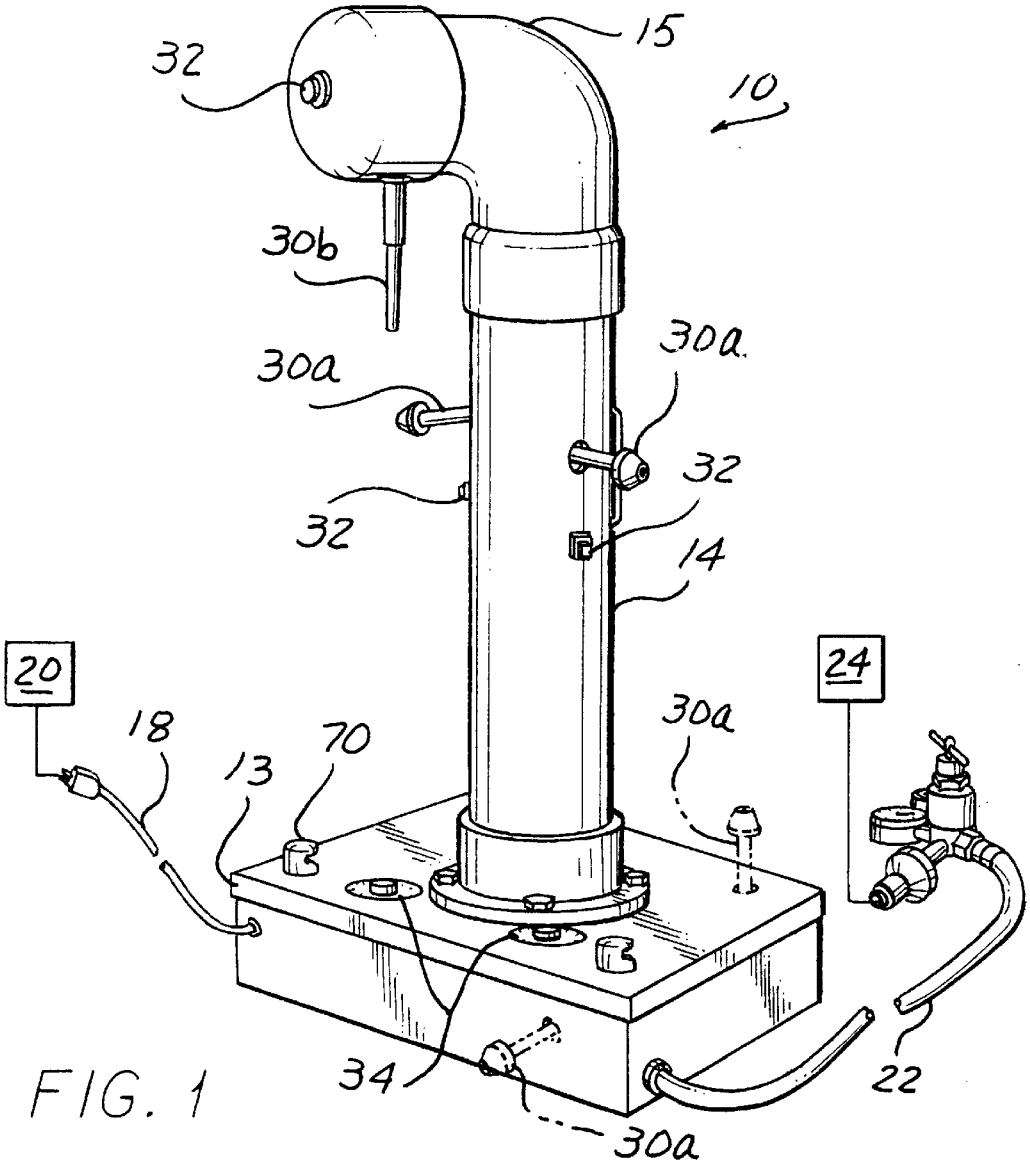
FIG. 1 is a perspective view of the apparatus for inflating balloons according to the present invention.

As illustrated in FIGS. 1–13, the invention provides a hands-free and automatic apparatus for inflating a single balloon or multiple number of balloons simultaneously, in sequence, or in random order. The apparatus 10 includes a rectangular, hollow base 12 for storing the electronic and pneumatic control components. A tower 14 extends from an upper surface of the base 12. Preferably, the base 12 is made of an aluminum material for durability, since the base 12 encloses the control components. The base 12 may have a removable or hinged lid 13 so that an operator may gain access to the control components. The tower is preferably a plastic or a light weight aluminum material to maintain the total weight of the apparatus to a minimum. As seen in FIG. 2, a center aperture 16 provides access from the base 12 to the tower 14 for electronic and pneumatic conduits to extend from the components in the base to the nozzle and activating switches in the tower 14.

The base 12 includes a first conduit 18 extending externally from the interior of the base 12 to a power source 20 and a second conduit 22 extending externally to a pressure gauge 24 with an end connectable to a pressurized gas source. The power source 20 may be a wall outlet or a 24 volt battery, or other variable voltage sources from 12–120 V. The pressurized gas may be any non-combustible and inert gas such as helium, nitrogen, carbon dioxide and compressed air. The second conduit 22 is directed to individual "on/off" solenoids 28. There is an individual "on/off" solenoid 28 for each nozzle opening 30*a* and 30*b*. The solenoids 28 are normally closed and actuated by buttons or toggle switches 32 positioned adjacent to its associated nozzle. When the button or toggle switch 32 is activated, the associated "on/off" solenoid 28 opens to allow the flow of pressurized gas through conduits 29 to the associated nozzle 30*a*, 30*b*. The pressurized gas continues flow through the nozzle until the solenoid 28 is switched to the "off" position. The solenoid 28 may be switched "off" by a sensor, timer, or manual activation.

In the present invention, it is preferred to regulate the inflation of a latex balloon in one manner. Balloons having a polyester film with a foil or metallic looking exterior are commonly referred to as Mylar™ balloons and are regulated in another manner. Latex balloons 38 come in a variety of sizes with known volumes. In the preferred embodiment it is intended to provide a dial or switch 34 for each nozzle for inflating a latex balloon 38. The dial or switch 34 will be provided on the base 12 for selection of a particular parameter by the user. The parameter is preferably the volume of the balloon to be inflated, however diameter size may be an alternative parameter. The selection on the dial or switch 34 on the base 12 of the apparatus 10 will be connected to and programmed to a timer 36 within the base 12. A low-voltage timer 36 is provided for each nozzle 30*a* available for inflating a latex balloon so that the timer 36 is compatible with a 24 volt source of power. The low-voltage timer 36 is preprogrammed for a specific time related to each selection on the dial or switch 34. The low-voltage timer 36 sends a signal to the associated solenoid 28 to move to the "off" position after the selected time has expired. The timer 36 will reset automatically for the next actuation.

Latex balloons 38 have an elasticity to the body of the balloon as well as in the neck portion. A typical latex balloon 38 includes a neck 40 having a single rib 42 along its free and opened end. The neck configuration of a latex balloon 38 allows for a gripping formation around tubular structures, such as a nozzle. However, when pressurized gas is blown into the balloon 38 through the tubular structures, the force of the pressurized gas overcomes the gripping tendency of the neck 40 of the balloon 38. As a result, if the balloon 38 is not physically held by the user or by mechanical means to the tubular structure, the balloon can be expelled from the tubular structure by the force of the pressurized fluid or gas. The present invention provides nozzle configurations for the latex balloon 38 that allow for installation of the balloon thereon with little effort. In addition, the configuration of the nozzle ends provide for a firm grip of the neck 40 of the balloon during the inflation process.

Figure 3:
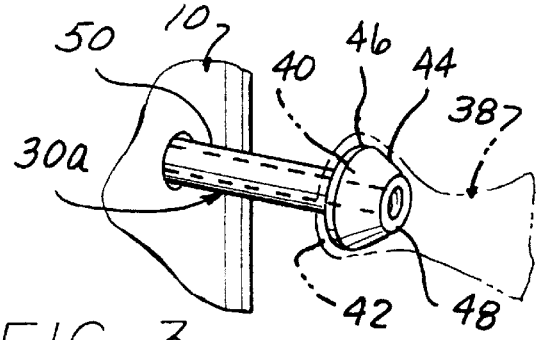
FIG. 3 is an enlarged view of a nozzle on the apparatus of FIG. 1.
Figure 4:
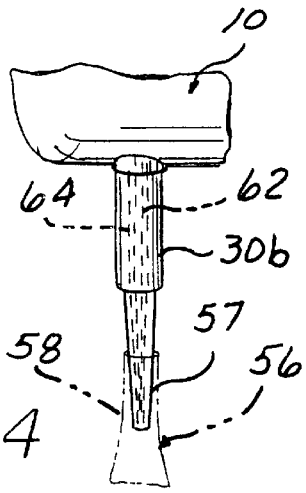
FIG. 4 is an alternative embodiment of a nozzle on the apparatus of FIG. 1.

FIG. 3 shows the preferred nozzle 30*a* for a latex balloon 38 with a balloon installed thereon shown in phantom. The nozzle 30*a* extends from the vertical tower 14 of the apparatus 10. The nozzle is a narrow, cylindrical tube 50 terminating at a frustoconical shape 44. The expanded end 46 of the frustoconical shape faces the tower 14 and tapers therefrom to the end opening 48. Therefore, an operator can install a balloon quickly and easily onto the nozzle 30*a,* shown in FIG. 3, by rolling the rib 42 of the balloon 38 around and up the tapered end of the frustoconical shape 44, until the rib 42 of the neck 40 grips the smaller diameter tube 50 of the nozzle 30*a.* When the inflation apparatus 10 is activated for this particular nozzle 30*a,* the force of the gas pressure through the nozzle can only move the neck 40 of the balloon to the expanded end 46 of the frustoconical shape 44. As a result, a mechanical device or the operator is not required to grip or hold the balloon 38 onto the nozzle 30*a.* This provides an advantage for the operator to accomplish other tasks during the inflation process.

Figure 6:
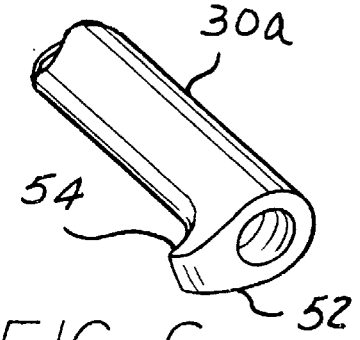
FIG. 6 is another alternative embodiment of a nozzle.
Figure 7:
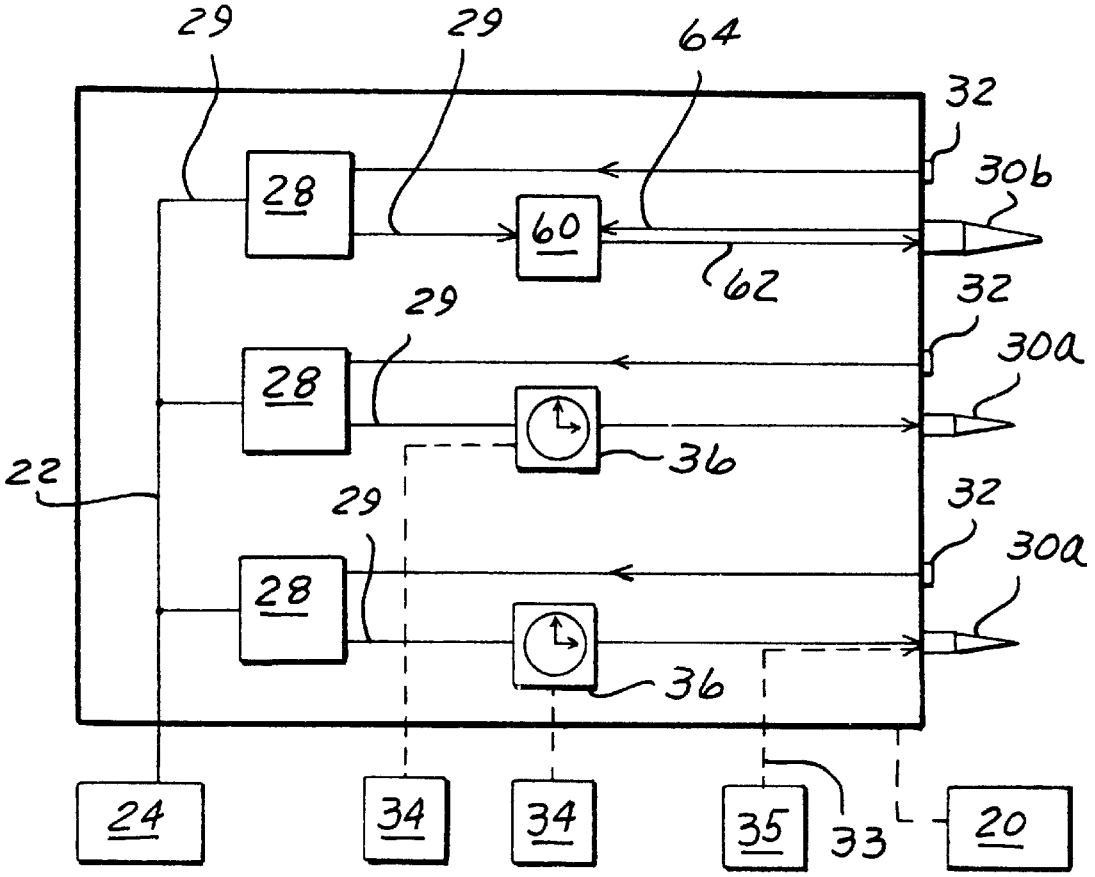
FIG. 7 is a schematic of the pneumatic system incorporated in the apparatus.

FIG. 6. shows an alternative embodiment of the end of the nozzle for a latex balloon 38. This nozzle has a teardrop formation 52 at its exposed end which allows the user to use the teardrop formation to insert within the neck 40 of the balloon and then expand the neck to grip around the tubular nozzle. The teardrop formation at the end of the nozzle 30*a* includes an inner face 54 with prevents the ribbed end 42 of the neck 40 of the balloon 38 to escape during the inflation process.

The Mylar™ balloon 56 does not include or have an expandable neck as is available in the latex balloon 38. Therefore, the nozzle for inflating a Mylar™ balloon 56 has a different configuration. The nozzle 30*b* for a Mylar™ balloon 56 is shown more clearly in FIG. 4. The nozzle 30*b* for the Mylar™ balloon 56 has a tapered end 57 upon which the neck 58 of the Mylar™ balloon 56 can grip. The tapered end 57 of the nozzle accommodates the various available sizes of Mylar™ balloons 56.

The inflation of the Mylar™ balloon 56 is activated in the same manner as for latex balloons 38. After installing the Mylar™ balloon 56 on the nozzle 30*b,* the user depresses the adjacent actuating button 32. The inflation of a Mylar™ balloon is automatically stopped by means of a pressure sensor 60. A pair of gas conduits extend to the nozzle 30*b* for a Mylar™ balloon. (This is shown more clearly in FIG. 2.) The first gas conduit 62 communicates with the gas pressure source and allows pressurized gas to the Mylar™ nozzle 30*b* when the solenoid 28 is in the "on" position. The second gas conduit 64 extends from the end of the nozzle 30*b* for a Mylar™ balloon 56 and terminates at the pressure sensor 60. The second gas conduit 64 transmits back pressure in the Mylar™ balloon 56 back to the pressure sensor 60 during the inflation process. Once the pressure has reached the predetermined level, the pressure sensor 60 signals the "on/off" solenoid 28 to the "off" position.

Figure 2:
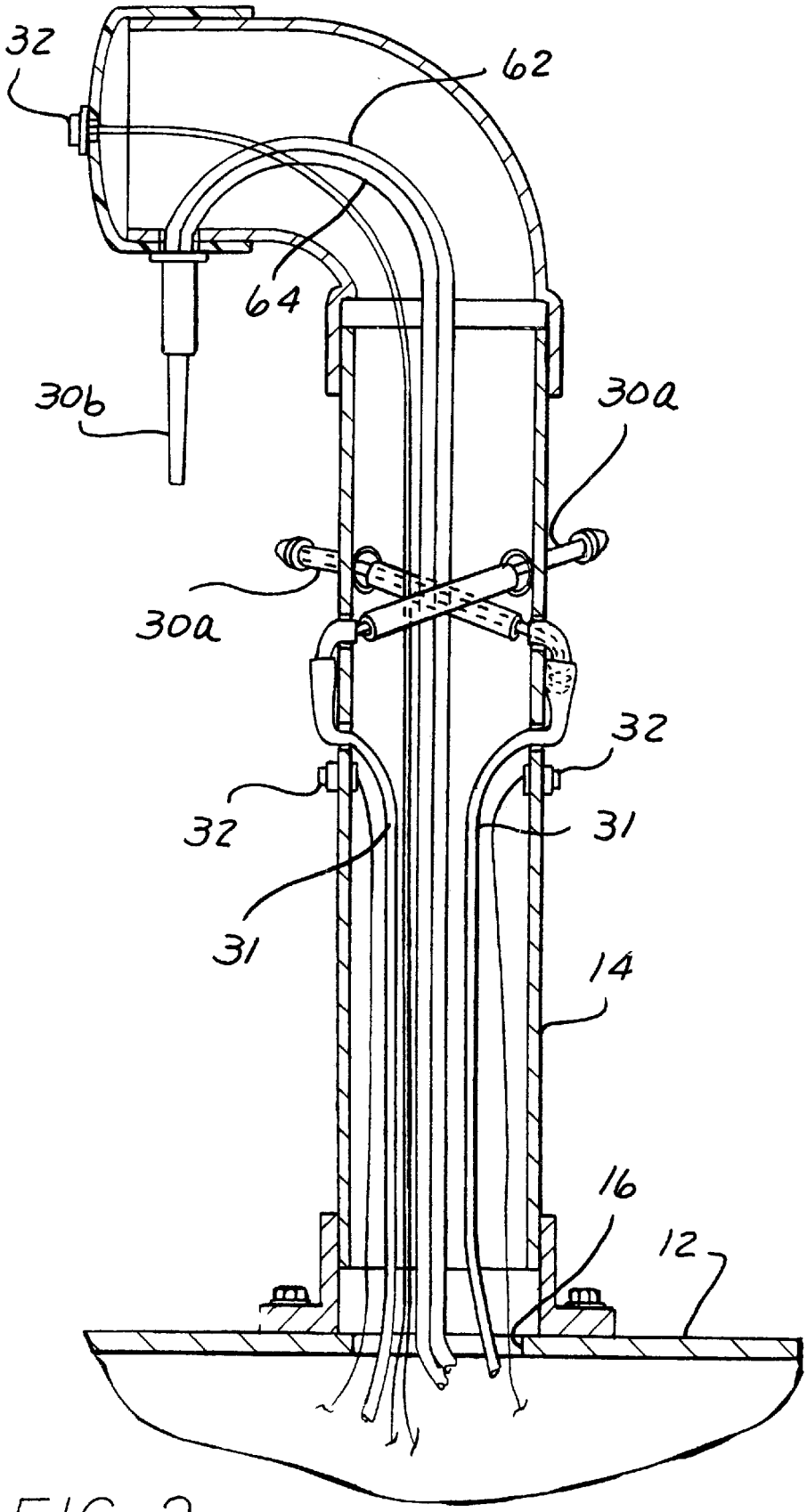
FIG. 2 is a sectional view of a portion of the apparatus illustrating a portion of the pneumatic and electronic system.

Because the pressure of the Mylar™ balloon 56 is constantly being monitored during the inflation process, it is preferred that the nozzle 30*b* for the Mylar™ balloon 56 is directed vertically downward when the base is positioned on a level surface as shown in FIG. 1. As the Mylar™ balloon 56 is being inflated, if the Mylar™ nozzle 30*b* is positioned horizontally or at an angle greater than approximately 45° from vertically downward, the Mylar™ balloon 56 tends to crimp at its neck 58 during the inflation process and cannot provide an accurate reading of the pressure in the Mylar™ balloon. The orientation of the nozzle 30*a* for latex balloons 38 during the inflation process is not as critical, except when used with a sealing product, such as Hi Float™. If a sealing product is used, the apparatus 10 may be provided with a separate conduit 33 to the nozzle 30*a* that is attached to the source of the sealing product 35. Further, if a sealing product is used, it is preferred that the nozzle 30*a* is directed horizontally so that the sealing product does not get into the air conduits 31.

Figure 5:
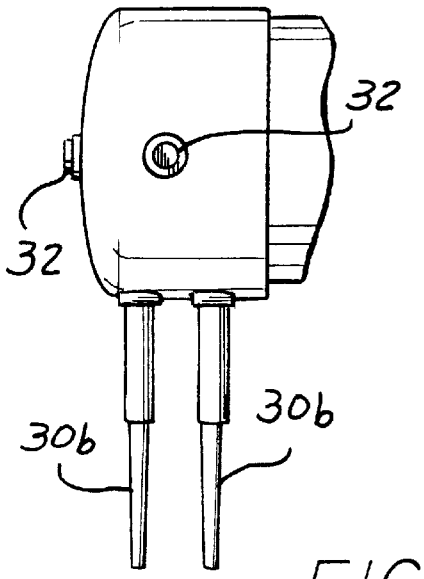
FIG. 5 is a portion of the apparatus of FIG. 1 showing multiple nozzles of the embodiment shown in FIG. 4.

Although the one embodiment as shown in FIG. 1 shows the nozzles 30*a,* 30*b* for inflating both Mylar™ and latex balloons located in the tower portion of the apparatus, other variations are possible. The tower formation provides surface area for multiple nozzles and actuating buttons for the apparatus. Although only two latex nozzles 30*a* and one Mylar™ nozzle 30*b* are shown extending from the tower 14, multiple nozzles for either latex and/or Mylar™ balloons may be positioned on the tower 14. FIG. 5 shows the top portion of the tower 14 including a pair of Mylar™ nozzles 30*b* and their associated actuating buttons 32.

Figure 8:
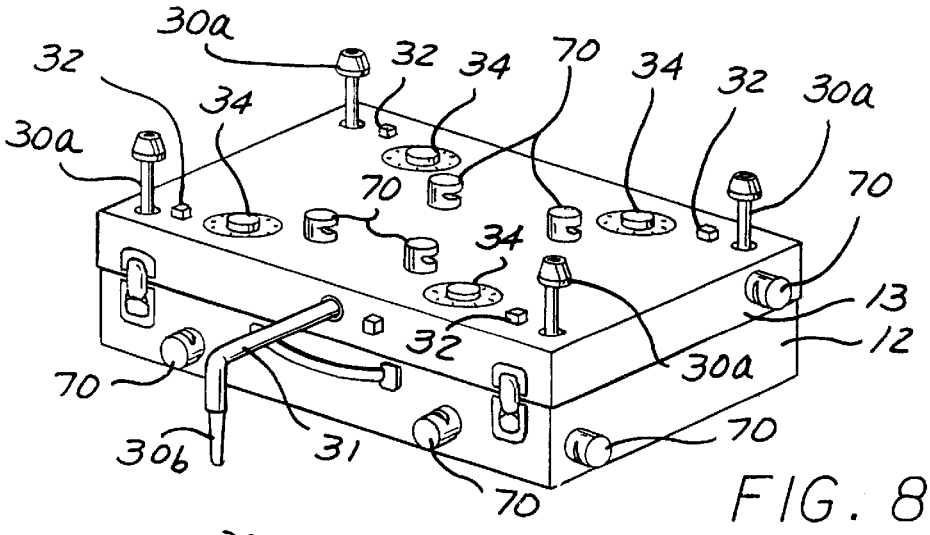
FIG. 8 is a perspective view of an alternative embodiment of the apparatus for inflating balloons.
Figure 9:
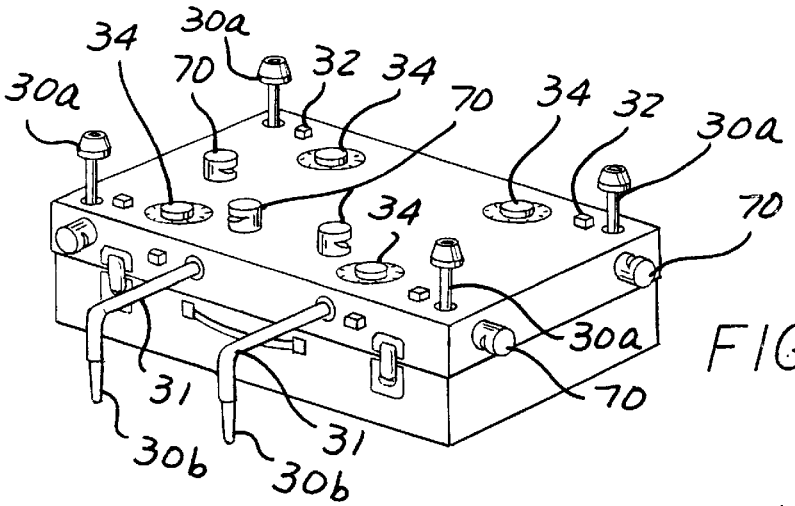
FIG. 9 is a perspective view of a second alternative embodiment of the apparatus for inflating balloons.
Figure 10:
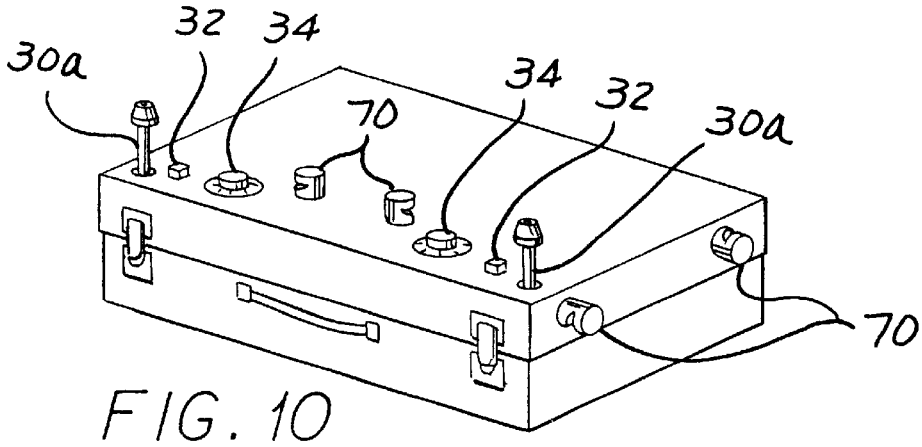
FIG. 10 is perspective view of a third alternative embodiment of the apparatus for inflating balloons.

In smaller versions of the apparatus of the present invention, as shown in FIGS. 8–10 the tower 14 may be eliminated so that the base 12 includes both the pneumatic and electric components as well as the extending nozzles 30*a,* 30*b.* FIG. 1 shows an example of the nozzles 30*a* for latex balloons extending from the base 12 in phantom. Although the apparatus, as shown in FIG. 1, encompassing a base 12 and a tower 14 can be easily transported from one commercial area to another commercial area easily, the smaller version, which encompasses only the base 12, allows for easier transport to outdoor picnic and home environments. The adaptability to function on twenty-four volts provides an advantage of being portable so that it can be hooked up to a power converter, which can then be hooked up to a 12 Volt outlet in a car i.e. a cigarette lighter.

FIG. 8 shows the apparatus 10 for inflating balloons without a tower 14 and yet having the capability of inflating four latex balloons through nozzles 30*a* and one Mylar™ balloon through nozzle 30*b* simultaneously, in sequence, or in random order.

Each nozzle 30*a,* 30*b* has an associated activation button 32. The nozzles 30*a* for latex balloons each have an associated switch 34 for selection of the appropriate parameter, such as volume or diameter of the balloon inserted over the particular nozzle 30*a*.

FIG. 9 shows another embodiment of the apparatus 10 without a tower 14. The embodiment in FIG. 9 provides for four latex balloon nozzles 30*a* and two Mylar™ balloon nozzles 30*b*. Each nozzle 30*a,* 30*b* has an associated activation button and each latex balloon nozzle 30*a* has an associated switch 34 for selection of the appropriate parameter of the balloon.

FIGS. 8 and 9 each illustrate a means for providing a Mylar™ nozzle 30*b* on the base 12 portion of the apparatus 10. For an accurate reading of the pressure in the Mylar™ balloon as it is being inflated, it is preferred that the nozzle 30*b* end extends vertically downwardly. In FIGS. 8 and 9, the nozzles 30*b* have an elbow or L-shape extension 31 and provide for limited rotatable movement relative to the base 12. The rotatable movement of the elbow extension 31 is preferably limited to 90° in either direction from the vertically downward position shown in the Figures. The rotatable movement of the elbow extensions 31 of nozzles 30*b* allow for easy packing, transporting and accommodating limited space at the site.

FIG. 10 is as embodiment of a smaller version of the apparatus 10 which provides two latex balloon nozzles 30*a* with its associated buttons 32 and switches 34.

Figure 11:
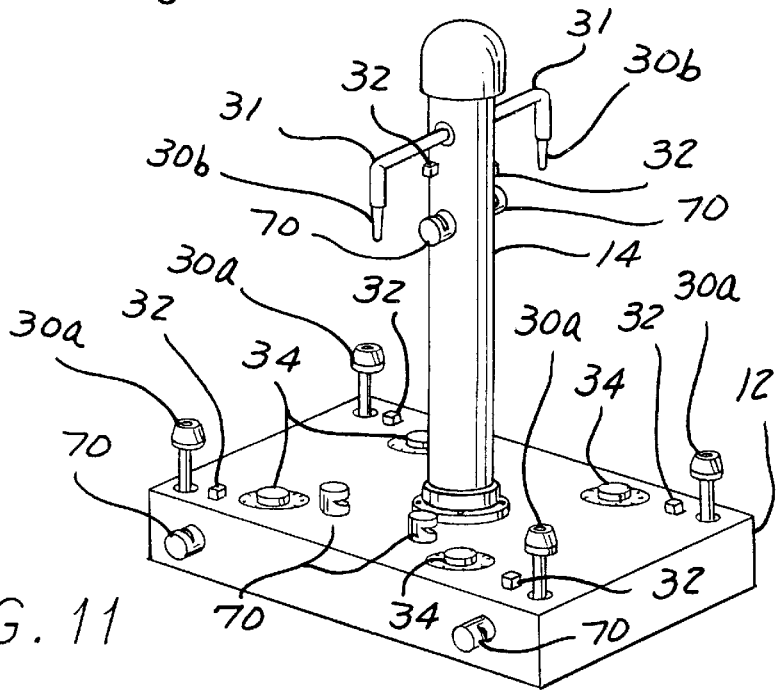
FIG. 11 is a perspective view of a fourth alternative embodiment of the apparatus for inflating balloons.

FIG. 11 is another embodiment of the apparatus having a different configuration of the tower 14. The tower 14 is cylindrically shaped and does not include an elbow shaped portion 15 at its upper end as shown in FIG. 1. A pair of Mylar™ nozzles 30*b* with rotatable elbow extensions 31 extend from the tower 14 in FIG. 11. Four latex balloon nozzles 30*a* extend upwardly from the base 12. Each nozzle 30*a,* 30*b* has an associated button 32. Each latex balloon nozzle 30*a* also includes an associated switch 34 for selection of the appropriate parameter of the balloon 38. Although, the Figures show the switch 34 in the base 12, the switch 34 may be located anywhere on the apparatus 10. Preferably the switch 34 is located proximate to its associated nozzle 30*a* to allow the operator to distinguish the appropriate switch 34 for the selected nozzle 30*a*. Other modifications may be provided as enhancements to the apparatus 10. As an example, the apparatus may be provided with ribbon cutters 70, preferably located on the base 12, for cutting the tie string or ribbon attached to the balloon by the operator. As can be seen in FIGS. 8–11 the ribbon cutters 70 may be placed at various locations on the apparatus 10 for easy access thereto. As seen in FIG. 11. the cutters 70 may also be located on the tower 14.

Figure 13:
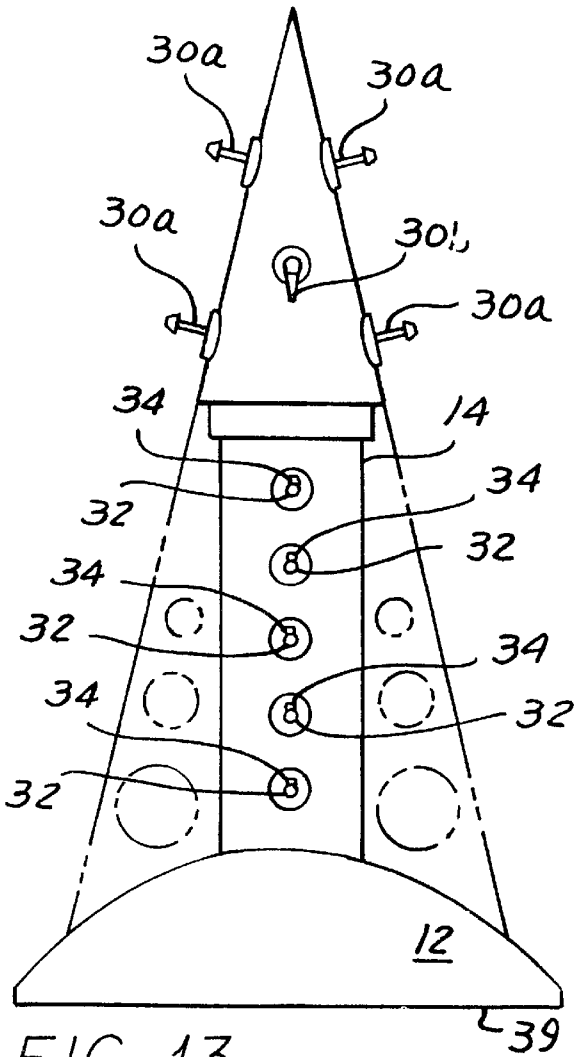
FIG. 13 is an elevational view of a sixth alternative embodiment of the apparatus for inflating balloons.
Figure 12:
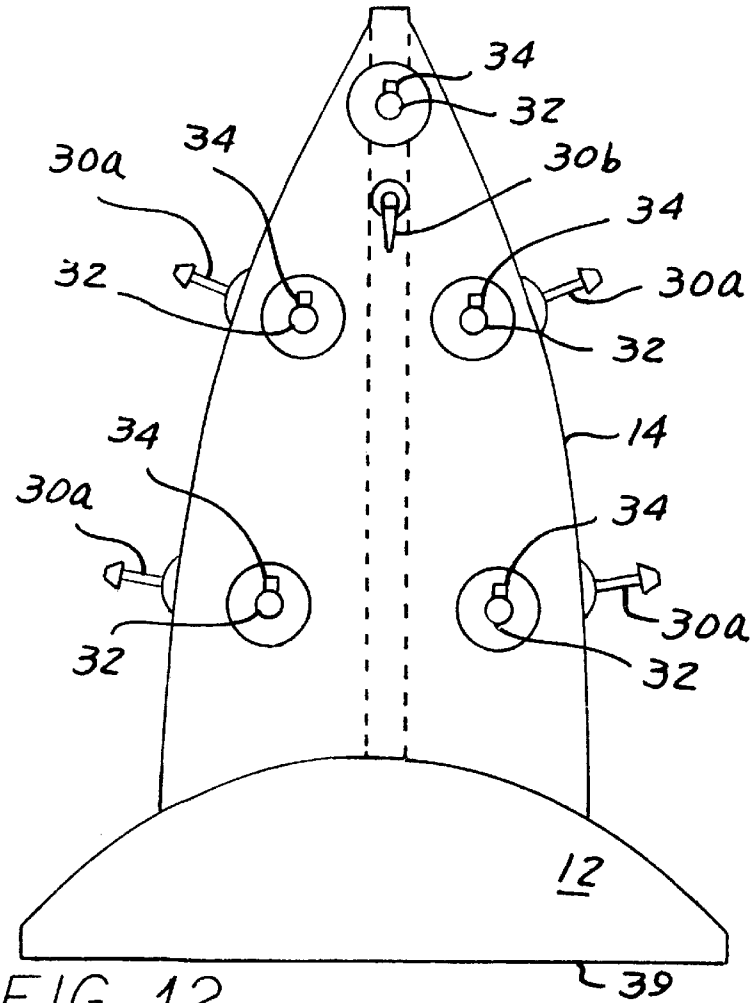
FIG. 12 is an elevational view of a fifth alternative embodiment of the apparatus for inflating balloons.

As another alternative, it may be preferred to incorporate the toggle switch or button 32 with the dial 34 as illustrated in FIGS. 12 and 13. Further, the toggle switch or button 32 can be used in conjunction with the dial 34 to indicate whether the balloon will be automatically inflated or manually inflated. As an illustrative example, if the dial 34 is positioned at the volume indicator of "0" then the toggle switch or button 32 functions in the manual mode to inflate the balloon only when the toggle switch 32 is positioned in the "on" position or when the button 32 is depressed. Once the button 32 is released or the toggle switch 32 is repositioned to the "off" mode, the inflation process is deactivated. However, if the dial 34 is set to a predetermined volume or diameter value greater than "0", the toggle switch or button 32 will function in the automatic mode as an automatic actuator as discussed supra. This feature allows the operator to selectively inflate the balloons either automatically or manually.

In instances where the operator initially inflates the balloon automatically, the operator may decide afterward to manually inflate the same balloon beyond the predetermined automatic volume. In those cases, the operator would place the dial or switch 34 into manual mode and depress button 32 to actuate the further inflation of the balloon. Once the operator releases the button 32 inflation will stop. Although FIGS. 12 and 13 show the manual or automatic modes incorporated with the button 32 and dial 34, the manual/automatic modes may be designated by a separate switch (not shown) placed adjacent to the button 32 or dial 34. Further, it is known that the embodiments in FIGS. 1–2 and 8–14 can incorporate a manual and automatic mode as well as the button and dial configuration shown in FIGS. 12 and 13.

FIGS. 12 and 13 also illustrate the various designs envisioned for the apparatus to provide interest and curiosity among the customers. Such designs could include space shuttles, rockets, as well as others. FIG. 13 also illustrates separating the button 32 and switch 34 from the nozzle 30*a,* 30*b*. An identifying symbol or color can be associated with each button 32 and switch 34 which matches the symbol or color on or near the corresponding nozzle 30*a,* 30*b*. Further, both FIGS. 12 and 13 illustrate that the base 12 can have other configurations, but preferably includes a flat bottom surface 39 for placement on another level surface, such as a table or the ground.

Figure 14:
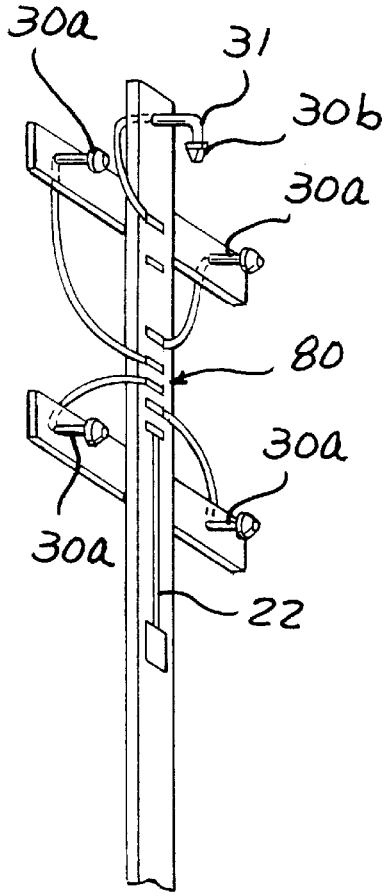
FIG. 14 is a perspective view of a skeletal infrastructure for the apparatus.
Figure 15:
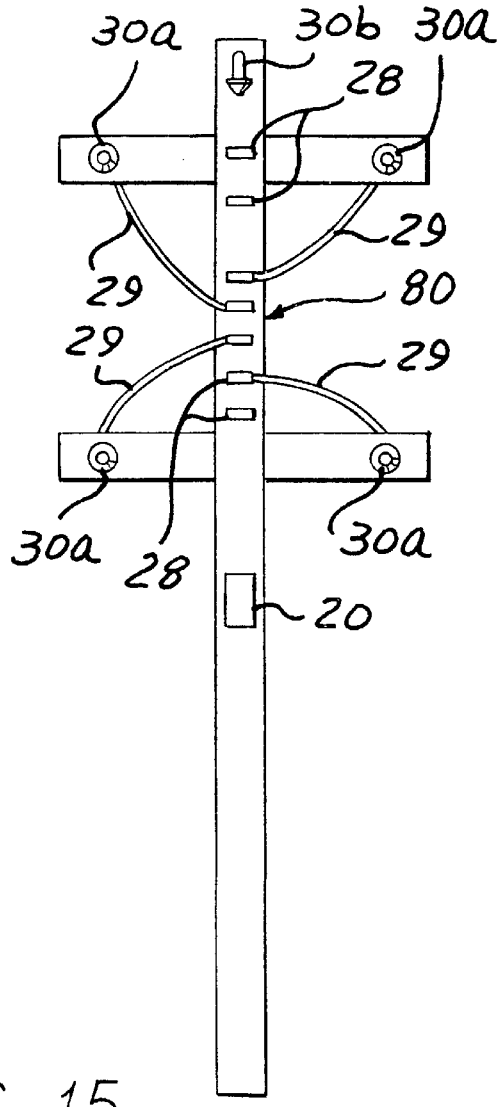
FIG. 15 is a front elevational view of the skeletal infrastructure in FIG. 12.

Another modification may include a skeletal infrastructure 80 (as shown in FIGS. 14–15) for housing or attaching the electronic and pneumatic control components within the tower 14. The skeletal infrastructure will have a configuration of at least a portion of the apparatus 10 for placement therein. The skeletal infrastructure 80 is preferably made of a light weight material. The infrastructure 80 provides conventional attachment means such as brackets for connecting the power supply (such as a 24 volt battery), the solenoid valves, and conduits thereto. The skeletal infrastructure 80 may also include the nozzles 30*a,* 30*b* extending therefrom. As can be seen, the apparatus 10 for inflating balloons can be any configuration (whether predominantly a vertical or horizontal structure) which will house the control components as well as the pneumatic lines.

The present invention provides a number of advantages over other devices in the prior art for inflating balloons. In particular, the present invention provides a hands-free and user-friendly apparatus that allows for a single or multiple number of balloons to be inflated at the same time, sequentially, or in random order. Once the balloons are connected to the nozzles and the associated activation switch is depressed, the apparatus operates automatically so that the operator may occupy that time with other tasks. For the retail store owner, the apparatus of the present invention occupies minimum space within the store. The present invention is a cost savings device which prevents overinflation of the balloons so that a savings of 30–40% consumption of the gas is realized. Operating the apparatus is simple and requires minimum effort and training of the store personnel.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for optionally inflating multiple balloons simultaneously, sequentially, or in random order, the apparatus comprising:

a housing defining a cavity therein;

a supply conduit stored in the housing and having one end connectable to a source of pressurized gas located outside of the housing and a second end communicating with at least one port through the housing;

an open port positioned through the housing providing access from the cavity to the exterior of the housing;

a nozzle securely connected to the open port and extending away from the housing for receiving a balloon thereon;

activation means on the housing for activating the pressurized gas through the open port; and control means for automatically terminating the flow of pressurized gas through the open port.

2. The apparatus of claim 1, wherein the nozzle is a narrow cylindrical tube terminating at a frustoconical shape.

3. The apparatus of claim 2, wherein there are at least two open ports for receiving at least two balloons each port having a nozzle extending therefrom and the apparatus further comprising means for inflating each balloon to a selectively different volume.

4. The apparatus of claim 1, wherein the nozzle is a narrow cylindrical tube having a tapered exposed end.

5. The apparatus of claim 4, wherein two conduits extend to the tapered exposed end of the nozzle, a first air conduit communicating with the source of pressurized gas and a second air conduit communicating with a pressure sensor.

6. The apparatus of claim 4, wherein said housing includes a base positionable on a level surface and said nozzle is orientated vertically downward ±45° when the base is positioned on the level surface.

7. The apparatus of claim 3, wherein at least one of the open ports has a nozzle with a tapered exposed end.

8. The apparatus of claim 7, wherein each port has an activation means.

9. The apparatus of claim 7, wherein each port has control means for automatically terminating the flow of pressurized gas.

10. The apparatus of claim 9, wherein the control means includes means for monitoring the back pressure at the nozzle when having a balloon disposed thereon.

11. The apparatus of claim 9, wherein the control means includes a timer communicating with the activation means, wherein the timer is set to a selectable predetermined value corresponding to the size of the balloon and said activation means is deactivated when the timer achieves the predetermined value.

12. The apparatus of claim 7, wherein said housing includes a base positionable on a level surface, and said base having the activation and control means stored therein.

13. The apparatus of claim 12, wherein said housing includes a tower secured to the base, said tower having at least one open port therethrough, said port in tower having a gas conduit extending therefrom to said control means in said base.

14. The apparatus of claim 12, wherein the base has at least one open port therethrough and a gas conduit extending from said open port to said control means.

15. The apparatus of claim 12, wherein said base has a removable lid for providing access to the activation and control means.

16. The apparatus of claim 15, wherein said housing includes a tower secured to the base, said tower having at least one open port therethrough, said port in tower having a pneumatic conduit extending therefrom to said control means in said base and said tower and base have a through aperture providing access from the base to the tower for extending pneumatic conduits therethrough.

17. The apparatus of claim 16, wherein a skeletal infrastructure is disposed in the tower for connection thereto of a portion of at least one of the control means and activation means.

18. An apparatus for inflating balloons releasibly connectable to a power source and a source of pressurized gas, the apparatus comprising:

means for selectively inflating a plurality of balloons simultaneously, wherein the means for selectively inflating the balloons includes at least two nozzles communicating with the source of pressurized gas, each nozzle has a free end for receiving a portion of one of the balloons thereon, wherein said free end is configured for a secure and releasibly sealing connection to the balloon during the inflation thereof.

19. The apparatus of claim 18 further comprises an actuator associated with each nozzle for selectively activating the delivery of pressurized gas to the associated nozzle in one of manual and automatic mode.

20. The apparatus of claim 19 further comprises means for automatically stopping the flow of pressurized gas to the balloon.

* * * * *